US007201084B2

(12) United States Patent
Yap

(10) Patent No.: US 7,201,084 B2
(45) Date of Patent: Apr. 10, 2007

(54) ADJUSTABLE RATCHET WRENCH

(75) Inventor: Wang Han Yap, Melaka (MY)

(73) Assignee: Power Bridge (Singapore) PTE Ltd, Bukit Batok St. (SG)

( * ) Notice: Subject to any disclaimer, the term of this patent is extended or adjusted under 35 U.S.C. 154(b) by 1 day.

(21) Appl. No.: 10/513,051

(22) PCT Filed: Apr. 25, 2003

(86) PCT No.: PCT/SG03/00095

§ 371 (c)(1),
(2), (4) Date: Oct. 29, 2004

(87) PCT Pub. No.: WO03/092958

PCT Pub. Date: Nov. 13, 2003

(65) Prior Publication Data

US 2005/0217435 A1 Oct. 6, 2005

(30) Foreign Application Priority Data

Apr. 29, 2002 (MY) ..... PI 20021555

(51) Int. Cl.
*B25B 13/28* (2006.01)
*B25B 13/16* (2006.01)
*B25B 13/00* (2006.01)

(52) U.S. Cl. ..... 81/111; 81/170; 81/124.5

(58) Field of Classification Search ..... 81/111, 81/170, 124.5, 178, 186, 99, 91.2
See application file for complete search history.

(56) References Cited

U.S. PATENT DOCUMENTS

| | | | | | |
|---|---|---|---|---|---|
| 794,597 | A | * | 7/1905 | Dunham | 81/90.2 |
| 2,471,537 | A | | 5/1949 | Norman | |
| 2,618,996 | A | * | 11/1952 | Logan | 81/111 |
| 3,541,898 | A | | 11/1970 | Murata | |
| 4,584,913 | A | * | 4/1986 | Logan | 81/91.2 |
| 4,773,287 | A | * | 9/1988 | Clarke | 81/90.2 |
| 5,896,790 | A | * | 4/1999 | Chiang | 81/98 |
| 5,957,008 | A | | 9/1999 | Long | |

* cited by examiner

*Primary Examiner*—Lee D. Wilson
*Assistant Examiner*—Alvin J. Grant
(74) *Attorney, Agent, or Firm*—Ladas & Parry LLP

(57) ABSTRACT

An adjustable wrench or spanner is disclosed. It comprises essentially an elongated handle element with a convex urging portion at one end, an upper jaw element with a concave urging portion, a lower jaw element with a protrusion portion and a ratchet assembly. The upper jaw element is movable with the assistance of the two engaging urging portions and the lower jaw element is adjustable with the assistance of the ratchet assembly. Two jaw portions are operable in tightening or loosening positions, without having to be disengaged from a hexagonal nut. When the jaw portions are opened in a loosening position, gripping edges of the jaw portions are allowed to shift from one width across flats to another width across flats.

8 Claims, 2 Drawing Sheets

ADJUSTABLE RATCHET WRENCH

TECHNICAL FIELD

This invention relates generally to adjustable ratchet wrench or spanner, and particularly to a wrench or spanner, with a ratchet adjustable lower jaw element and a movable upper jaw element.

BACKGROUND

A prior art wrench or spanner is a tool for gripping and turning hexagonal nuts on screws, bolts and so on. There are various designs of the prior art wrench or spanner. For an example, a fork spanner comprises essentially a handle portion integrally cast with one U-shaped gripping portion at each end, where the two extending elements of the U-shaped gripping portion are parallel to each other permanently. For another example, a ring spanner comprises essentially a handle portion integrally cast with one ring gripping portion at each end. Yet, another example is an adjustable spanner which comprises essentially a handle portion with an adjustable gripping portion, where an upper jaw element of the gripping portion is generally immovable and a lower jaw element is ratchet adjustable. In use, the gripping portion is adjusted to fit a width across flats of a hexagonal nut. After a tightening or loosening action, the wrench or spanner will be displaced from its initial position. To continue with the action, the wrench or spanner needs to be removed from the nut firs, and then engages a new width across flats of the nuts. This latter engaging movement may be cumbersome and difficult to achieve, depending on certain circumstances.

U.S. Pat. No. 5,957,008 discloses a new adjustable wrench construction wherein the same can be utilised for including forward, reverse and neutral positions. The inventive device comprises in combination, a ratchet head assembly, an upper handle portion, an intermediate connector portion, a lower handle portion and a push button disposed within a cylindrical housing. The ratchet assembly allows a gripping portion to be placed over a hexagonal nut. The tightening or loosening action of the nut can be continually carried out, without having to shift from the widths across flats.

SUMMARY OF THE INVENTION

A main object of this invention is to allow a continual tightening or loosening action of a wrench or spanner on a hexagonal nut to be carried out, without having to disengage from the nut.

Another object is to teach a new and inventive wrench or spanner, with a ratchet adjustable lower jaw element and a movable upper jaw element.

Yet, another object is to teach an adjustable wrench or spanner which is of a durable and reliable construction.

Still yet another object is to teach a new and inventive wrench or spanner which may be easily and efficiently manufactured and marketed.

To achieve the above objects, this invention teaches a new and inventive wrench or spanner which comprises essentially an elongated handle element, with two jaw portions disposed generally in a parallel orientation, when tightening a nut. The space in between gripping edges of the two jaw portions constitutes the mouth of the gripping portion. The upper jaw portion is movable with the assistance of two engaging urging portions and the lower jaw portion is adjustable with the assistance of a ratchet assembly.

BRIEF DESCRIPTION

In order that the present invention may be more readily understood, the following description is given by way of example, of one specific embodiment of an adjustable wrench or spanner made in accordance with the present invention. Reference will be made to the accompanying drawings, in which.

DETAILED DESCRIPTION

For ease of explanation, the present invention will be described hereafter where a wrench or spanner is placed in an upward orientation with a convex urging portion (11) above an elongated handle element (1). Similar features on different components of the invention are differentiated with suffices like "a" and "b". A hexagonal nut has three pairs of widths across flats. In the subsequent explanation, two different widths across flats of a hexagonal nut are denoted as "f1" and "f2". When a plan view of the nut is looked at, a tightening action of the nut implies a clockwise movement about the central axis of the nut, whereas a loosening action implies an anti-clockwise movement.

Figure 1:
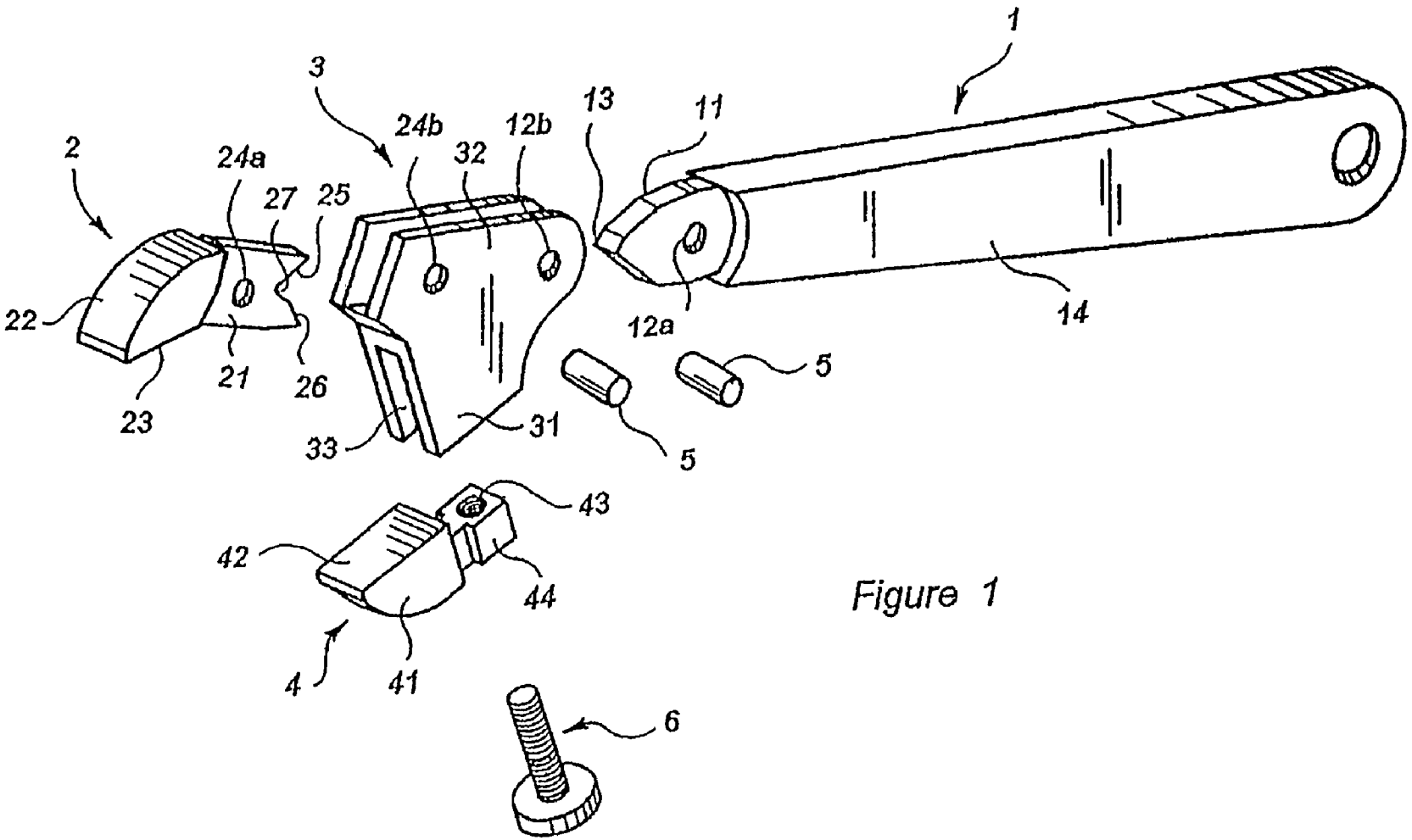
FIG. 1 is an exploded perspective view of various components making up the present invention.

As seen in FIG. 1, various components making up his invention are shown, comprising an elongated handle element (1) with a convex urging portion (11) at one end, an upper jaw element (2) with a concave urging portion (21), a lower jaw element (4) with a square protrusion portion (44) and a ratchet assembly (3). All the components can be considered generally flat.

The convex urging portion (11) is of a substantially reduced dimension than that of a handle portion (14), the two portions (11, 14) making up the elongated handle element (1). The convex urging portion (11) carries a first pin position (12*a*), which is to be aligned with another first pin position (12*b*) on the ratchet assembly (3). The handle portion (14) and the convex urging portion (11) rotate about this first pin position (12) which acts as a fulcrum. It is important to note that the longitudinal axis of this handle element (1) passes through the centre of the first pin position (12) and a convex tip (13) of the convex urging portion (11).

An upper jaw portion (22) is integrally adapted with the concave urging portion (21), the two portions (22, 21) making up the upper jaw element (2). The upper jaw portion (22) carries an upper gripping edge (23) which operates in combination with a lower gripping edge (42) of a lower jaw portion (41). The space in between the two gripping edges (23, 42) constitutes the mouth of the gripping portion of the invention. The concave urging portion (21) carries a second pin position (24*a*) which is to be aligned with another second pin position (24*b*) on the ratchet assembly (3). The upper jaw portion (22) and the concave urging portion (21) rotate about the second pin position (24) which also acts as a fulcrum.

The concave urging portion (21) includes an upper converging edge (25) and a lower converging edge (26) meeting at a converging point (27). It is important to note that the longitudinal axis of the upper jaw element (2) passes through the second pin position (24) and the converging point (27) of the concave urging portion (21). A spring means (not shown) is disposed underneath the concave urging portion (21). It is also important to note that the length of the concave urging portion (21) is substantially longer than the length of the convex urging portion (11).

An example of the ratchet assembly will be described below. The ratchet assembly (3) comprises essentially a housing body (31) and an elongated U-channel portion (32) which integrally meets with the housing body (31) in an inclined orientation. The elongated U-channel portion (32) is provided with a first pin position (12*b*) and a second pin position (24*b*). The concave urging portion (21) of the upper jaw element (2) and the convex urging portion (11) of the elongated handle element (1) are received inside a hollow passage defined in the elongated U-channel portion (32). Two pins (5) are inserted through these first and second pin positions (12, 24). The two urging portions (11, 21) engage each other between the two pin positions (12, 24), acting as fulcrum. A vertical square opening is provided inside the housing body (31). A side vertical slot (33) along the side surface of the housing body (31) meets the vertical square opening, forming another hollow passage for the slidable movement of the lower jaw element (4). The lower jaw element (4) includes the square protrusion portion (44) which carries an internally threaded hole (43). An adjustment shaft or screw (6) passes through this hollow passage and engages the internally threaded hole (43) on the square protrusion portion (44). The exposed end of the adjustment shaft or screw (6) is an adjustment knob. By turning the knob, the lower jaw element (4) moves slidable up and down along the adjustment shaft or screw (6). The space between the gripping edges (23, 42) of the upper and lower jaw portions (22, 41) is thus adjusted to fit a width across flats of a hexagonal nut.

Figure 2:
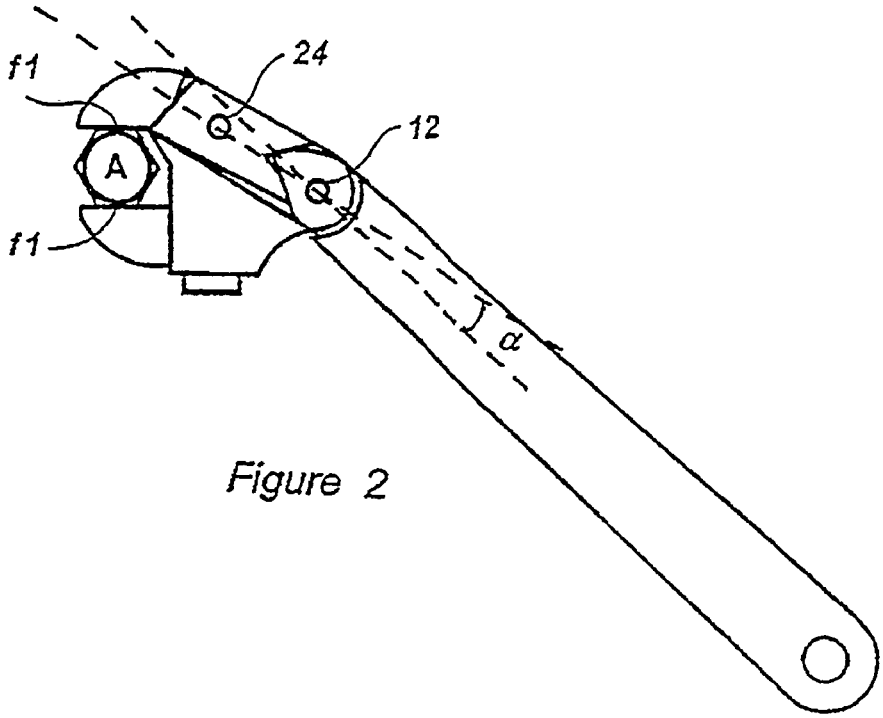
FIG. 2 is a side view of the present invention in a tightening position engaging a width across flats, partially exposing the relative positions of two urging portions actuating its upper jaw portion of the gripping portion.

It is important to note that the gripping edges (23, 42) of the upper and lower jaw portions (22, 41) are preferably parallel to each other, in a tightening position. In tightening position, the elongated handle element (1) is given a clockwise torque about the first pin position (12), as illustrated in FIG. 2. The convex tip (13) of the convex urging portion (11) urges the upper converging edge (25) of the concave urging portion (21) upwardly. This, in turn, translates into an anti-clockwise torque about the second pin position (24). The gripping edge (23) of the upper jaw portion (22) moves downwardly to assume the parallel orientation with the gripping edge (42) of the lower jaw portion (41). The longitudinal axis of the handle element (1) thus forms an inclined angle with the longitudinal axis of the upper jaw element (2). The angle ($\alpha$) is approximately in the range of 8° to 12°.

To assist in the urging action, a spring means is disposed between the base of the elongated U-channel portion (32) and the concave urging portion (21). There can be several examples of this spring means. As an example of explanation, a plate spring is fitted under the concave urging portion (21). This spring would naturally induces the above-mentioned angle ($\alpha$). This may be considered as the default orientation of the urging portions (11, 21). At this default orientation, the gripping edges (23, 42) of the jaw portions (22, 41) are naturally parallel. The longitudinal axis of the handle element (1) is naturally inclined at an angle ($\alpha$) with the longitudinal axis of the upper jaw element (2).

Figure 3:
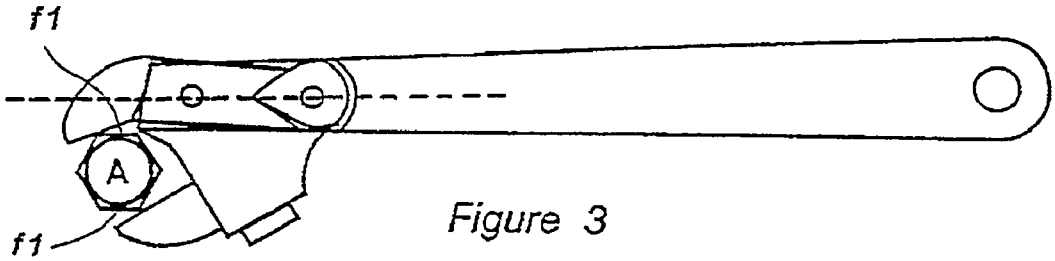
FIG. 3 is a side view of the present invention in a releasing position negotiating a shift to a new width across flats, partially exposing the relative positions of two urging portions actuating its upper jaw portion of the gripping portion.
Figure 4:
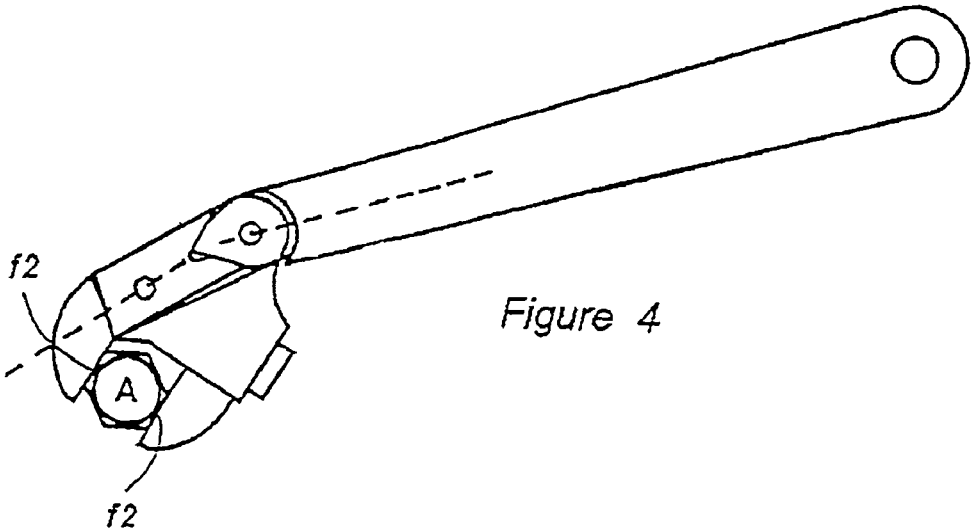
FIG. 4 is a side view of the present invention in a tightening position engaging a new width across flats, partially exposing the relative positions of two urging portions actuating its upper jaw portion of the gripping portion.

In a loosening position as seen in FIG. 3, the elongated handle element (1) is given an anti-clockwise torque about the first pin position (12). The convex tip (13) meets up with the converging point (27). The longitudinal axis of the handle element (1) and the upper jaw element (2) aligns and forms substantially a straight line. The mouth of the gripping portion is said to be opened, which allows the gripping edges (23, 42) to shift from one width across flats (f1) to another adjacent width across flats (f2), as shown in FIG. 4, without having to disengage from the hexagonal nut.

The wrench or spanner can be made of metallic material, preferably stainless steel, for better strength and stability.

The invention claimed is:

1. A wrench or spanner comprising:

a ratchet assembly;

an elongated handle element with a convex urging portion at one end pivotally connected to the ratchet assembly;

an upper jaw element with a concave urging portion pivotally connected to the ratchet assembly;

a lower jaw element with a protrusion portion adjustably connected to the ratchet assembly; and wherein the upper jaw element is movable with the assistance of the two engaging urging portions;

wherein two jaw portions are operable in tightening or releasing positions, negotiating different widths across flats of a hexagonal nut and without having to be disengaged from the nut when in a loosening position.

2. An adjustable wrench or spanner as in claim 1 in which the elongated handle element, which is equipped with the convex urging portion defining a convex tip, is rotatable about a first pin position; the upper jaw element, which is equipped with a reduced concave urging portion defining a converging point, is rotatable about a second pin position; the convex tip engages the converging point between the two pin positions in a tightening or loosening position; whereby gripping edges of the upper and lower jaw portions, defining the mouth of the gripping portion of this invention, closes and opens respectively.

3. An adjustable wrench or spanner as in claim 2 in which the longitudinal axis of the handle element passes through the convex tip and the first pin position; the longitudinal axis of the upper jaw element passes through the converging point and the second pin position; whereby the longitudinal axis of the handle element and the upper jaw element are inclined at an angle ($\propto$) to each other in a tightening position.

4. An adjustable wrench or spanner as in claim 3 in which the inclined angle ($\propto$) ranges from 8° to 12°.

5. An adjustable wrench or spanner as in claim 2 in which the longitudinal axis of the handle element passes through the convex tip and the first pin position; the longitudinal axis of the upper jaw element passes through the converging point and the second pin position; whereby the longitudinal axis of the handle element and the upper jaw element are aligned substantially in a straight line in a loosening position.

6. An adjustable wrench or spanner as in claim 1 in which the ratchet assembly comprises essentially a housing body equipped with an elongated U-channel portion, a vertical opening is provided inside the housing body, a vertical slot along the side surface of the housing body, and an adjustment shaft or screw with an adjustment knob, whereby the U-channel portion integrally meets with the housing body in an inclined orientation; the U-channel portion is provided with a first pin position, a second pin position, and a hollow passage of the elongated U-channel portion receiving the concave urging portion of the upper jaw element and the convex urging portion of the elongated handle element; the vertical hollow passage receives slidably the protrusion portion with an internally threaded hole; the adjustment shaft or screw passes through the vertical hollow passage and engages the internally threaded hole, and the lower jaw element moves slidably up and down along the adjustment shaft or screw by turning the adjustment knob.

7. An adjustable wrench or spanner as in claim 1 further comprising a spring means is disposed between the base of an elongated U-channel portion and the concave urging portion, such that the longitudinal axis of the handle element is naturally urged at an inclined angle ($\propto$) with the longitudinal axis of the upper jaw element, whereby the concave urging portion is spring-assisted.

8. An adjustable wrench or spanner as in claim 1 in which the length of the concave urging portion is substantially longer than the length of the convex urging portion.

* * * * *